US007587981B2

(12) United States Patent
Theurer et al.

(10) Patent No.: US 7,587,981 B2
(45) Date of Patent: Sep. 15, 2009

(54) METHOD FOR CLEANING BALLAST OF A TRACK

(75) Inventors: Josef Theurer, Vienna (AT); Manfred Brunninger, Altenberg (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 0 days.

(21) Appl. No.: 11/811,255

(22) Filed: Jun. 8, 2007

(65) Prior Publication Data

US 2007/0283835 A1 Dec. 13, 2007

Related U.S. Application Data

(63) Continuation of application No. PCT/EP2005/050168, filed on Jan. 17, 2005.

(51) Int. Cl.
*E01B 29/04* (2006.01)

(52) U.S. Cl. ..... 104/7.3

(58) Field of Classification Search ..... 104/2, 104/7.1, 7.3

See application file for complete search history.

(56) References Cited

U.S. PATENT DOCUMENTS 4,357,874 A * 11/1982 Theurer ..... 104/2
4,538,687 A * 9/1985 Theurer et al. ..... 171/16
5,257,580 A 11/1993 Theurer et al.
5,926,981 A 7/1999 Theurer

OTHER PUBLICATIONS

"Eisenbahningenieur" (52) Aug. 2001, p. 81 ("New cleaning chain for ballast bed cleaning machine RM 800") to follow.

"Eisenbahningenieur" (52) Aug. 2001, p. 81 ("New cleaning chain for ballast bed cleaning machine RM 800") (Spec, p. 2).

* cited by examiner

*Primary Examiner*—S. Joseph Morano
*Assistant Examiner*—Robert J McCarry, Jr.
(74) *Attorney, Agent, or Firm*—Collard & Roe, P.C.

(57) ABSTRACT

A method for cleaning ballast of a track comprising rails extending in a longitudinal direction is executed by means of a ballast cleaning machine having a machine frame supported on on-track undercarriages. The machine includes a cleaning chain with a chain cross member extending perpendicularly to the longitudinal direction. At the start of the cleaning process, an on-track undercarriage situated immediately ahead of the cleaning chain, with regard to a working direction of the ballast cleaning machine, is lifted off the track. The rails are severed, and the track is lifted, after which the chain cross member of the cleaning chain is positioned underneath the track. Finally, the on-track undercarriage is set down upon the track again.

2 Claims, 1 Drawing Sheet

METHOD FOR CLEANING BALLAST OF A TRACK

CROSS REFERENCE TO RELATED APPLICATIONS

Applicants claim priority under 35 U.S.C. §120 of International Application No. PCT/EP2005/050168 filed on Jan. 17, 2005. This application is a by-pass continuation application of said International Application No. PCT/EP2005/050168 filed on Jan. 17, 2005. The International application under PCT Article 21(2) was not published in English. The disclosure of the aforementioned International application is incorporated by reference herein.

BACKGROUND OF THE INVENTION

1. Field of the invention

The invention relates to a method for cleaning ballast. More particularly, the invention relates to a method for cleaning ballast of a track comprising rails extending in a longitudinal direction, said method being carried out by means of a ballast cleaning machine. The machine has a machine frame supported on on-track undercarriages and includes a cleaning chain with a chain cross member extending perpendicularly to the longitudinal direction.

The invention also relates to a machine for carrying out said method.

2. The Prior Art

An article in the the trade journal "Eisenbahningenieur" (52) 8/2001, page 81 ("New cleaning chain for ballast bed cleaning machine RM 800") describes a method of this type. According to this method, the track has to be severed at the start of cleaning in order to be able to position a chain cross member of a special, very efficient cleaning chain of a ballast cleaning machine in the ballast bed underneath the track. A machine of this type is known, for example, from U.S. Pat. No. 5,926,981. During working operations of this machine, the machine frame is supported at each end on the track by means of a respective on-track undercarriage. According to a further version, visible in FIG. 2 of said patent disclosure, the on-track undercarriage situated in front of the cleaning chain, with regard to a working direction of the machine, can be distanced from the chain during working operations.

According to U.S. Pat. No. 4,538,687, it is known to lift an on-track undercarriage, positioned immediately ahead of the cleaning chain of a ballast cleaning machine, permanently off the track during working operations. As a result, it is possible even in this section to impart to the track a deflection curve necessary for lifting the track. The raised on-track undercarriage merely serves for mobility of the machine during transfer travel in order to be able to move or guide the machine within the track clearance profile.

SUMMARY OF THE INVENTION

It is the primary object of this invention to improve a method and machine of the first-described type which will allow the chain cross member of the chain to be positioned underneath the track in a problem-free manner also on machines of shorter length.

This object is accomplished in accordance with the invention with a method for cleaning ballast of a track, comprising rails extending in a longitudinal direction, by means of a ballast cleaning machine. Said machine has a machine frame supported on on-track undercarriages and includes a cleaning chain with a chain cross member extending perpendicularly to the longitudinal direction. At the start of the cleaning process, according to the method disclosed, an on-track undercarriage situated immediately ahead of the cleaning chain, with regard to a working direction of the ballast cleaning machine, is lifted off the track, and the rails are severed. Then the track is lifted, the chain cross member of the cleaning chain is positioned underneath the track, and the on-track undercarriage is set down upon the track again.

This method is particularly suited for machines intended especially for working operations in track sections having tight curve radii. With the temporary lifting of the undercarriage positioned at the front end of the machine frame, while the severed track section situated in front in the working direction is raised, the chain cross member can automatically work itself deeper into the ballast bed until the desired working position is reached. For the subsequent working operation, the front on-track undercarriage is lowered upon the track again. Likewise, after finishing the working operation, the chain cross member can be lifted out of the track again by carrying out the said steps in reverse order. Despite a shorter length of the machine, this method makes it possible to advantageously arrange the screening plant immediately following the cleaning chain.

The object of the invention is also accomplished with a ballast cleaning machine comprising a machine frame having a front end and a rear end with regard to a working direction of the machine. On-track undercarriages are arranged at the front end and the rear end, respectively. A vertically adjustable endless cleaning chain is positioned between the two on-track undercarriages, and a vertical adjustment drive is provided between the front end of the machine frame and a rear end of a further machine frame arranged preceding said front end in the working direction.

BRIEF DESCRIPTION OF THE DRAWINGS

Other benefits and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE DRAWINGS

Figure 1:
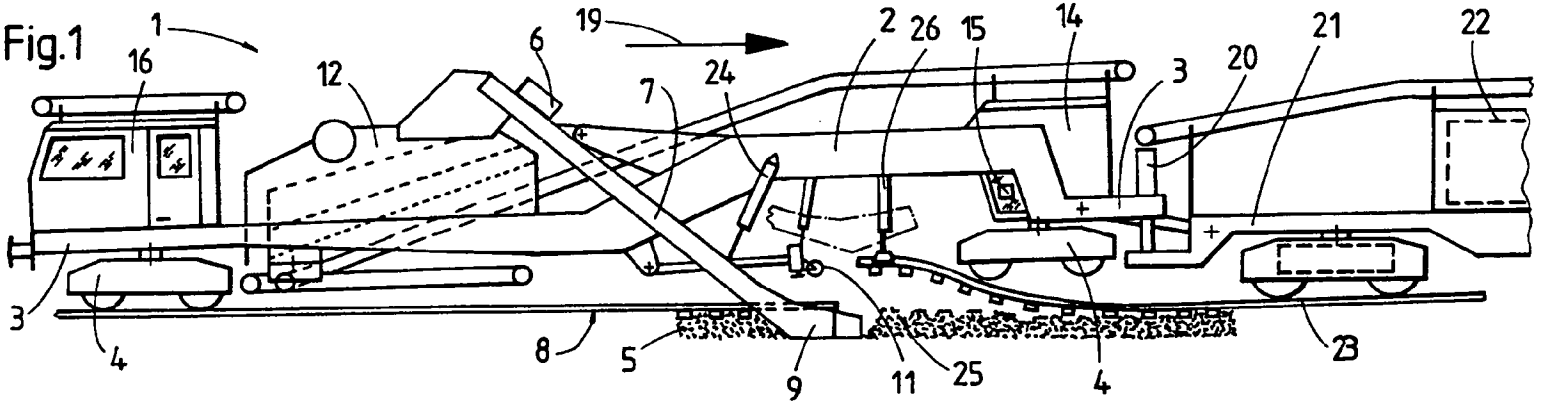
FIG. 1 shows a side view of a ballast cleaning machine immediately prior to a cleaning operation.
Figure 2:
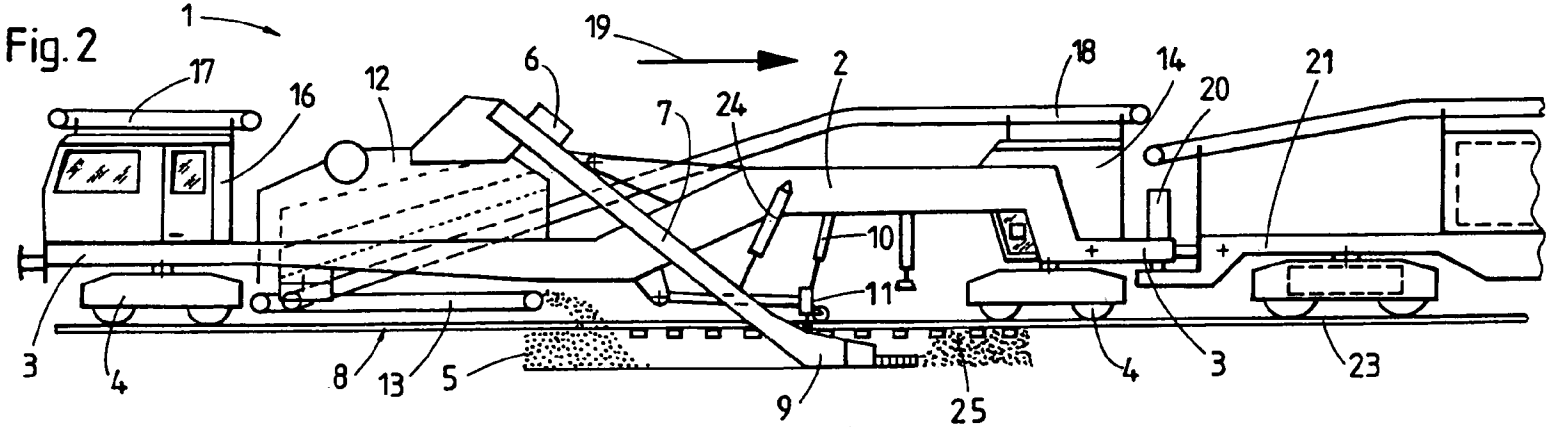
FIG. 2 shows a side view of the machine during the cleaning operation.

Referring now in detail to the drawings, FIGS. 1 and 2 show a machine 1 for cleaning ballast 5 of a track 8 having rails 23 extending in a longitudinal direction. The machine 1 comprises a machine frame 2 having two ends 3 spaced from one another with respect to said longitudinal direction. At each end 3, a respective on-track undercarriage 4 is arranged. An endless cleaning chain 7, designed to be set in rotation by means of a drive 6, has a chain cross member 9 positioned underneath the track 8 and extending perpendicularly to the longitudinal direction of the machine during working operations. Arranged above said chain cross member 9 is a track lifting device 11 which is vertically adjustable by means of a drive 10.

On the machine frame 2, a screening plant 12 having a discharge conveyor belt 13 is provided for cleaning the ballast 5. Arranged at the front end 3 of the machine frame 2—with respect to a working direction indicated by arrow 19—is a work cabin 14 with a control unit 15. At the rear end 3, a driver's cab 16 is situated, including a conveyor belt 17 for supplying new ballast as needed. Spoil accumulating as a result of the ballast cleaning operation is removed with the aid of a conveyor belt arrangement 18.

Fastened to the front end 3 of the machine frame 2 is a hydraulically vertically adjustable ram, or vertical adjustment drive 20, which can be supported on a further machine frame 21 situated at the front in the working direction 19. On said further machine frame, a power unit 22 for supplying energy to the machine 1 is located.

At the start of the working operation (see FIG. 1), the hydraulic ram or vertical adjustment drive 20 is actuated, causing the front end 3 of the machine frame 2 to be lifted and thus also the front on-track undercarriage 4 to be raised off the track 8. Subsequently, both rails 23 of the track 8 are severed, and a track section, situated forwardly in the working direction 19, of the severed track 8 is raised with. the aid of an auxiliary lifting device 26 until the chain cross member 9 can be positioned without problems between the raised front track section and the lower track section. With actuation of the drive 6, the chain of the cleaning chain 7 is set in rotation, and the latter is lowered by means of drives 24 in parallel with a slow advance of the machine 1 in the working direction 19. In this manner, the chain cross member 9 automatically digs itself into a ballast bed 25 until the desired position underneath the track level is reached (FIG. 2).

The two severed rails 23 are subsequently connected to one another by means of fish-plates. The front on-track undercarriage 4 is lowered upon the track 8 again by retraction of the ram or vertical adjustment drive 20. While the two machine frames 2 and 21 coupled to one another advance in the working direction 19, the continuous process for cleaning the ballast 5 now begins. After termination of the cleaning process, the rails 23 are disconnected again, and the front on-track undercarriage 4 is lifted again in order to be able to raise the chain cross member 9 for transfer travel of the machine 1.

Accordingly, while an embodiment of the present invention has been shown and described, it is obvious that many changes and modifications may be made thereunto without departing from the spirit and scope of the invention.

What is claimed is:

1. A method for cleaning ballast of a track, comprising rails extending in a longitudinal direction and connected to ties resting on the ballast, by means of a ballast cleaning machine having a machine frame supported on on-track undercarriages and including a cleaning chain with a chain cross member extending perpendicularly to the longitudinal direction, wherein, at the start of the cleaning process, a) an on-track undercarriage situated immediately ahead of the cleaning chain, with regard to a working direction of the ballast cleaning machine, is lifted off the track;

b) the rails of the track are cut;

c) one end of the cut rails, including the ties connected thereto, ahead of the cleaning chain in the working direction is lifted;

d) the chain cross member of the cleaning chain is positioned underneath the lifted ties;

e) the cut rails are reconnected, and the on-track undercarriage is set down upon the track again.

2. The method of claim 1 wherein, for the purpose of lifting the on-track undercarriage off the track, an end of the machine frame adjoining the on-track undercarriage is lifted by being supported on a further machine frame preceding in the working direction.

* * * * *